US005375570A

United States Patent [19]

Swain

[11] Patent Number: 5,375,570

[45] Date of Patent: Dec. 27, 1994

[54] ENGINE COMPRESSION RELEASE

[75] Inventor: James C. Swain, Columbus, Ohio

[73] Assignee: Gas Research Institute, Chicago, Ill.

[21] Appl. No.: 114,676

[22] Filed: Aug. 31, 1993

[51] Int. Cl.[5] ..... F02N 17/00

[52] U.S. Cl. ..... 123/182.1

[58] Field of Search ..... 123/182.1; 417/299

[56] References Cited

U.S. PATENT DOCUMENTS

| | | | |
|---|---|---|---|
| 3,223,076 | 12/1965 | Isoda | 123/182.1 |
| 3,339,659 | 9/1968 | Isoda | 123/182 |
| 3,782,354 | 1/1974 | Tuckey | 123/182 |
| 3,893,440 | 7/1975 | Dooley | 123/182.1 |
| 4,018,203 | 4/1977 | Legros | 123/182 |
| 4,200,079 | 4/1980 | Darlington | 123/179 G |
| 4,414,933 | 11/1983 | Pribnow | 123/182 |
| 5,007,391 | 4/1991 | Nomoto | 123/182 |

FOREIGN PATENT DOCUMENTS 0348924 1/1990 European Pat. Off. ..... 123/182.1

*Primary Examiner*—David A. Okonsky

*Attorney, Agent, or Firm*—Philip M. Dunson; Philip J. Pollick

[57] ABSTRACT

Apparatus and methods are provided for relieving the compression pressure while starting an internal combustion engine 10. A passage 12 communicates via end openings 22 and 22a between the compression space 13 and the exhaust region 19 in the head 20 of the engine. A spring 16 presses against one side of a piston 15 in a valve 21, holding an end portion 23 away from the opening 22 until the engine speed exceeds the cranking speed. The pressure of the engine's lubricating oil 18 on the opposite side of the piston 15 then forces the end portion 23 against the opening 22, to close the passage 12 and permit the engine to continue running with full compression.

19 Claims, 1 Drawing Sheet

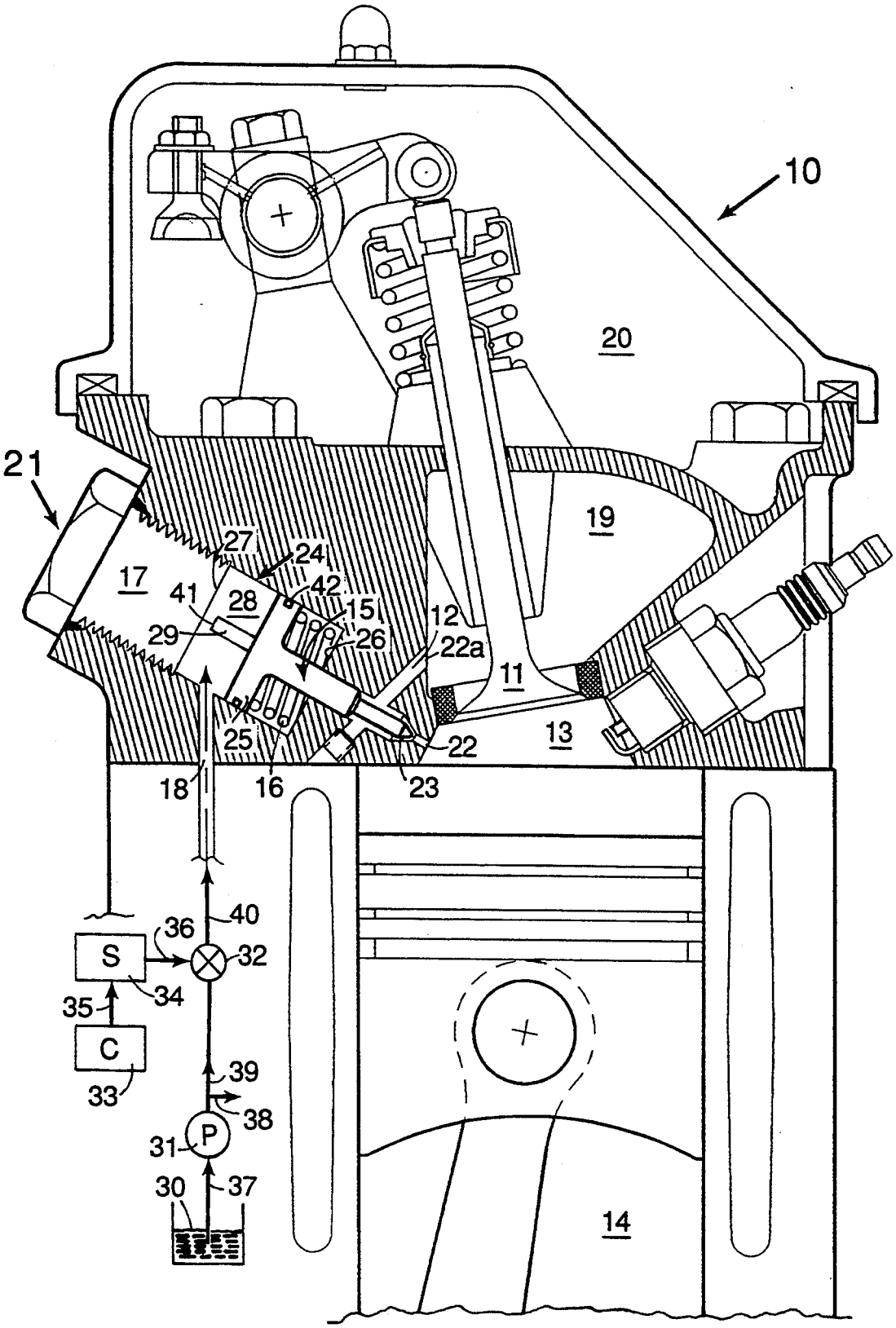
10
20
21
19
17
27
24
42
41
28
15
12
29
26
22a
11
25
22
13
18
16
23
40
36
S
32
34
35
C
33
39
38
31
P
30
37
14

ENGINE COMPRESSION RELEASE

FIELD

This invention relates to apparatus and methods for relieving the compression pressure in internal combustion engines. It has to do particularly with relieving compression under predetermined conditions where full compression could be detrimental, and typically during starting.

BACKGROUND

Of interest in connection with the present invention are the U.S. Pat. Nos. 3,399,659 of Isoda and 4,200,079 of Darlington.

The patent of Isoda relates to a noncompression starting device made integrally with the valve rocker arm chamber of an engine. While starting, a diaphragm having a spindle directly engageable with an exhaust valve rocker arm is urged by a spring acting on one side of the diaphragm to press the exhaust valve to an open or noncompression position. Lubricating oil is introduced on the other side of the diaphragm, and when the engine is cranked to a predetermined speed, the pressure of the oil overcomes the spring biasing force, thus releasing the pressure against the exhaust valve and allowing it to open and close normally.

The patent of Darlington is directed to an engine oil pressure operated system wherein a solenoid valve is electrically energized simultaneously with the starter motor to supply oil pressure from the engine oil pump to a first piston-in-cylinder device, to move a fuel injection pump lever from "stop" to "run" so that fuel supply always depends upon adequate oil pressure. Oil pressure on the piston, opposing the force of a spring, keeps the fuel valve closed after the engine is running. A similar piston-in-cylinder device, which may be used with or without the first one, moves a control arm to change the engine from decompression (exhaust valve open) during starting, to compression when the oil pressure overcomes the force of the spring.

Engine compression release devices according to the present invention are smaller, simpler, and less expensive than those of Isoda or Darlington. They also differ considerably from the prior devices as they do not act on the exhaust valve, but provide an independent path for release of compression pressure.

Darlington's objective is to protect the bearings of large multi-cylinder engines by preventing the engines from firing and/or relieving the cylinder compression pressure until the bearings are well lubricated.

The present invention has a similar beneficial effect by lowering the compression pressures for the initial cranking period, but this is not a primary objective. The primary objective was to minimize size and cost, and overcome some problems associated with the electric cranking motor on a relatively high compression, single cylinder engine.

Small, single cylinder, gasoline engines for lawn and garden service are sometimes equipped with electric starters and sometimes utilize manual starting. Such engines do not have high compression ratios, but they usually employ some means of compression release for cranking. A common type mechanically holds one valve open during cranking until a centrifugal force mechanism comes into play and allows the valve to function normally. On two-cycle engines which have no valves, a very small hole through the piston serves to reduce compression pressure at low cranking speed without having too adverse an effect on performance at normal running speeds.

The present invention was conceived and developed for an electric cranked one-cylinder engine having a high compression ratio. Without compression release, electric cranking is made difficult by two factors. First, the flywheel of the engine cannot be counted on to carry the piston through top dead center on the first compression stroke, since the flywheel may not have achieved sufficient speed. There is no control over exactly where the engine is in its rotational cycle when the cranking motor engages. So the cranking motor must have enough torque and/or a high enough gear ratio to carry through top dead center on its own. The second factor is called "pumping of the Bendix mechanism." After the piston goes over top dead center, it is possible under some conditions that the compression pressure will drive the engine forward instantaneously faster than the cranking motor. This causes the torque to reverse on the overrunning Bendix mechanism, which forces the cranking pinion briefly out of engagement with the ring gear on the engine. The engine has an oil pump. The mechanical compression release schemes were not durable enough for the long life requirements of the engine. The small hole through the piston scheme was not favored because of concern over long-term fouling by carbon deposits and by concern about degrading engine efficiency at low operating speeds. This invention uses the lubricating oil pump to facilitate a simple and long-lived compression release that allows the use of a smaller cranking motor and mitigates the Bendix mechanism pumping problem.

DISCLOSURE

Typical apparatus according to the present invention for relieving the compression pressure in an internal combustion engine comprises a passage through which gas can flow away to the atmosphere from the compression space in a cylinder of the engine; a piston in a valve, for selectively opening and closing the passage; and means responsive to the pressure in the liquid lubricant in the engine for controlling the position of the piston.

The piston has an end portion that extends adjacent to an end opening of the passage, and is held away from contact therewith, by a spring, when the opposing pressure of the lubricant is less than a predetermined amount. The end portion of the piston is pressed against the opening, and thus closes off the passage, when the lubricant pressure is at least the predetermined amount.

A typical method according to the invention comprises providing a passage independent of the exhaust valve and the inlet valve through which gas can flow away from the compression space in a cylinder of the engine, and selectively opening and closing the passage in response to the pressure in the liquid lubricant in the engine. For controlling the compression while the engine is being started, the passage typically is held open until the engine speed exceeds the cranking speed.

The opening and closing of the passage typically are provided by an axially slidable piston in a valve, the piston having an end portion extending adjacent to an end opening of the passage for plugging and unplugging that opening. The piston typically is urged in a path-opening direction by a spring, and is urged in a path-closing direction by the pressure in the lubricant.

DRAWING

The single figure is a partly sectional and partly schematic view showing typical apparatus according to the present invention for relieving the compression pressure in an internal combustion engine, responsive to the pressure in the liquid that lubricates the engine.

CARRYING OUT THE INVENTION

Referring now to the drawing, typical apparatus according to the present invention for relieving the compression pressure in an internal combustion engine 10 comprises means independent of the exhaust valve 11 and the inlet valve for providing a path 12 through which gas can flow away from the compression space 13 in a cylinder 14 of the engine, movable means 15 for selectively opening and closing the path 12, and means 16–18 responsive to the pressure of the liquid lubricant 30 in the engine for controlling the position of the movable means 15.

The path comprises a passage 12 communicating between the compression space 13 and the atmosphere via end openings 22 and **22*a* between the compression space 13 and the exhaust region 19, or the inlet region, in the head 20 of the engine; or between the compression space 13** and the crankcase.

The movable means comprises a piston 15 in a valve 21 for plugging and unplugging one end opening 22 of the passage 12 by axial motion of the piston 15. The piston 15 has a first end portion 23 that is adjacent to the opening 22 and is held away from contact therewith when the pressure of the lubricant 30 is less than a predetermined amount. The end portion 23 of the piston 15 is pressed against the opening 22, and thus closes off the path 12 between the compression space 13 and the exhaust region 19, when the pressure of the lubricant 30 is at least the predetermined amount. The piston 15 has a seal 42 on the outer diameter of the portion 25 to prevent leakage of the oil 30.

Typically, the apparatus is constructed and arranged to keep the path 12 open during starting, at least until the engine fires, to minimize the load on the cranking motor. The apparatus typically keeps the path 12 open until the engine reaches a predetermined speed that is greater than the cranking speed.

The piston 15 typically is urged in the direction away from the opening 22 by resilient means 16 comprising, in the main body 24 of the valve 21, a compression spring 16 pressing at one end against a second end portion 25 of the piston 15 that is away from the first end portion 23 and pressing at the other end against the end surface 26 of the main body 24 that is nearer to the opening 22. Typically, the main body 24 of the valve 21 is closed by a surface 27 of a closure plug 17 at the end of the main body 24 that is farther from the opening 22, and includes a region 28 between the farther surface 27 and the end portion 25 of the piston 15.

The piston 15 has a second end extended portion 29 with an end surface 41. When the piston 15 is shifted to the open position by the spring 16, the end surface 41 contacts the surface 27 of the closure plug 17 and prevents the portion 25 of the piston from covering the passage 18.

The region 28 communicates via a passage 18 with the liquid lubricant 30 in the engine, so that the pressure of the lubricant 30 urges the piston 15 in the direction toward the opening 22.

Typically, a first conduit 37 conveys lubricant 30 from a supply thereof to a pump 31. The pump 31 furnishes the lubricant 30 via a second conduit 39, a control valve 32, and a third conduit 40, to the passage 18; and the apparatus typically comprises means 33,34 responsive to a condition in the engine for selectively opening and closing the control valve 32. The opening and closing means 33,34 typically comprises control means 33 responsive to engine speed, for providing a control signal 35 to means 34, such as a solenoid, responsive thereto for determining the position of a movable member 36 in the control valve 32. Item 38 is a schematic representation of the oil gallery typical in the engine for serving various points in the engine requiring lubrication.

In other typical embodiments of the invention the control valve 32, solenoid 34, and control means 33 are eliminated, and the pressure of the oil 30 is allowed to act on the piston 15 as it rises with engine speed. By proper engineering of the engine oil circuits and components and choice of the spring 16 this simple scheme can be arranged to keep the piston 15 in the open position at cranking speeds, but close it when the engine reaches normal idling speeds.

A typical method according to the present invention for controlling the compression pressure in an internal combustion engine 10 comprises providing a path 12 independent of the exhaust valve 11 and the inlet valve through which gas can flow away from the compression space 13 in a cylinder 14 of the engine, and selectively opening and closing the path 12 in response to the pressure of the liquid lubricant 30 in the engine. For controlling the compression while the engine is being started, the path 12 typically is held open until a predetermined condition in the engine is present.

The opening and closing of the path 12 typically are provided by a movable member 15 that is urged in a path-opening direction by resilient means 16 and is urged in a path-closing direction by the pressure of the lubricant 30. Typically the path comprises a passage 12; and the movable member comprises an axially slidable piston 15 in a valve 21, the piston 15 having an end portion 23 extending adjacent to an end opening 22 of the passage 12 for plugging and unplugging that end opening 22.

While the forms of the invention herein disclosed constitute currently preferred embodiments, many others are possible. It is not intended herein to mention all of the possible equivalent forms or ramifications of the invention. It is to be understood that the terms used herein are merely descriptive rather than limiting, and that various changes may be made without departing from the spirit or scope of the invention.

I claim:

1. Apparatus for relieving the compression pressure in an internal combustion engine (10) including a cylinder, an inlet valve, an exhaust valve, compression space, an exhaust region in a head, a crankcase, and liquid lubricant, said apparatus comprising means, independent of the position of the exhaust valve (11) and the position of the inlet valve, for providing a path (12) through which gas can flow away from the compression space (13) in the cylinder (14), movable means (15) for selectively opening and closing the path (12), and means (16–18) responsive to pressure of the liquid lubricant (30) for controlling the position of the movable means (15).

2. Apparatus as in claim 1, wherein the path comprises a passage (12) communicating between the compression space (13) and the atmosphere.

3. Apparatus as in claim 2, wherein the passage (12) communicates via a first end opening (22) and a second end opening (22*a*) between the compression space (13) and the exhaust region (19) in the head (20) of the engine.

4. Apparatus as in claim 1, wherein the movable means comprises a piston (15) in a valve (21) having a main body (24), for plugging and unplugging a first end opening (22) of the passage (12) by axial motion of the piston (15).

5. Apparatus as in claim 4, wherein the piston (15) has a first end portion (23) that is adjacent to the first end opening (22) and is held away from contact therewith when the pressure of the lubricant (30) is less than a predetermined amount.

6. Apparatus as in claim 5, wherein the first end portion (23) of the piston (15) is pressed against the first end opening (22), and thus closes off the path (12) between the compression space (13) and the exhaust region (19), when the pressure of the lubricant (30) is at least the predetermined amount.

7. Apparatus as in claim 6, constructed and arranged to keep the path (12) open during starting, at least until the engine fires, to minimize the load on the cranking motor.

8. Apparatus as in claim 7, constructed and arranged to keep the path (12) open until the engine reaches a predetermined speed that is greater than the cranking speed.

9. Apparatus as in claim 6, wherein the piston (15) is urged in the direction away from the first end opening (22) by resilient means (16).

10. Apparatus as in claim 9, wherein the resilient means comprises, in the main body (24) of the valve (21), a compression spring (16) pressing at one end against a second end portion (25) of the piston (15) that is away from the first end portion (23) and pressing at the other end against the end surface (26) of the main body (24) that is nearer to the first end opening (22).

11. Apparatus as in claim 10, wherein the main body (24) of the valve (21) is closed by a surface (27) at the end (17) of the main body (24) that is farther from the first end opening (22), and includes a region (28) between the farther surface (27) and the second end portion (25) of the piston (15).

12. Apparatus as in claim 11, wherein the region (28) between the farther surface (27) and the second end portion (25) of the piston (15) communicates via a passage (18) with the liquid lubricant (30) in the engine, so that the pressure of the lubricant (30) urges the piston (15) in the direction toward the first end opening (22).

13. Apparatus as in claim 12, wherein a pump (31) furnishes the lubricant (30) via a control valve (32) to the passage (18).

14. Apparatus as in claim 13, comprising means (33, 34) responsive to a condition in the engine for selectively opening and closing the control valve (32).

15. Apparatus as in claim 14, wherein the opening and closing means (33,34) comprises means (33) for providing a control signal (35) to means (34) responsive thereto for determining the position of a movable member (36) in the control valve (32).

16. A method of controlling the compression pressure in an internal combustion engine (10) including a cylinder, an inlet valve, an exhaust valve, compression space, an exhaust region in a head, a crankcase, and liquid lubricant, said method comprising providing a path (12), independent of the position of the exhaust valve (11) and the position of the inlet valve, through which gas can flow away from the compression space (13) in the cylinder (14), and selectively opening and closing the path (12) in response to pressure of the liquid lubricant (30) in the engine.

17. A method as in claim 16, for controlling the compression while the engine is being started, wherein the path (12) is held open until a predetermined condition in the engine is present.

18. A method as in claim 17, wherein the opening and closing of the path (12) are provided by a movable member (15) that is urged in a path-opening direction by resilient means (16) and is urged in a path-closing direction by pressure of the lubricant (30).

19. A method as in claim 18, wherein the path comprises a passage (12); and the movable member comprises an axially slidable piston (15) in a valve (21), the piston (15) having an end portion (23) extending adjacent to an end opening (22) of the passage (12) for plugging and unplugging that end opening (22).

* * * * *